US006552691B2

(12) United States Patent
Mohuchy et al.

(10) Patent No.: US 6,552,691 B2
(45) Date of Patent: Apr. 22, 2003

(54) BROADBAND DUAL-POLARIZED MICROSTRIP NOTCH ANTENNA

(75) Inventors: Wolodymyr Mohuchy, Nutley, NJ (US); Peter A. Beyerle, Kettering, OH (US); Andrew B. MacFarland, Beavercreek, OH (US)

(73) Assignee: ITT Manufacturing Enterprises, Wilmington, DE (US)

( * ) Notice: Subject to any disclaimer, the term of this patent is extended or adjusted under 35 U.S.C. 154(b) by 0 days.

(21) Appl. No.: 09/867,591

(22) Filed: May 31, 2001

(65) Prior Publication Data

US 2002/0180655 A1 Dec. 5, 2002

(51) Int. Cl.[7] ..... H01Q 13/10
(52) U.S. Cl. ..... 343/770; 343/797
(58) Field of Search ..... 343/767, 770, 343/771, 795, 797

(56) References Cited

U.S. PATENT DOCUMENTS

| | | | | |
|---|---|---|---|---|
| 3,836,976 A | | 9/1974 | Monser et al. | 343/795 |
| 4,978,965 A | | 12/1990 | Mohuchy | 343/727 |
| 5,268,701 A | * | 12/1993 | Smith | 343/767 |
| 5,309,165 A | * | 5/1994 | Segal et al. | 343/770 |
| 5,786,792 A | * | 7/1998 | Bellus et al. | 343/770 |
| 5,845,391 A | * | 12/1998 | Bellus et al. | 343/770 |
| 6,133,888 A | | 10/2000 | Mohuchy | 343/770 |

OTHER PUBLICATIONS

Chio, T., et al., "Parameter Study and Design of Wide–Band Widescan Dual–Polarized Tapered Slot Antenna Arrays", *IEEE Transactions on Antennas an Propagation*, Jun. 2000, vol. 48, No. 6, pp. 879–886.

* cited by examiner

*Primary Examiner*—Hoang Nguyen
(74) *Attorney, Agent, or Firm*—RatnerPrestia

(57) ABSTRACT

A dual-polarized radiator for a phased array antenna includes two planar microstrip notch elements that interlock and are perpendicular to each other having their phase centers coincident to provide advantageous operational characteristics when the elements are used to form a wide bandwidth, wide scan angle phased array antenna.

18 Claims, 4 Drawing Sheets

BROADBAND DUAL-POLARIZED MICROSTRIP NOTCH ANTENNA

BACKGROUND OF THE INVENTION

1. Field of the Invention

This invention relates generally to an antenna structure and, in particular, to dual-polarized radiating elements that can be excited via control networks to select any desired polarization in space and which are suitable for use in transmitting and/or receiving phased arrays.

2. Discussion of the Background Art

In radio frequency (RF) antenna design the objective is to provide a design which is compatible with a feed network, can be manufactured using low cost batch techniques while providing broad bandwidth impedance match and pattern characteristics. Conventional notch antennas consist of a double-sided metalization on a dielectric substrate having the form of a flared slot. This conventional antenna includes a transition from a feed line to the notch antenna slot line which requires a slot line open circuit. In addition, the transition requires a short circuit through the circuit board.

A first notch antenna design is shown in U.S. Pat. No. 3,836,976 to Monser et al. The Monser et al patent discloses a phased array antenna which is comprised of a plurality of vertical radiating elements and a plurality of horizontal radiating elements which are arranged in a linear array and which are fixed to a back wall which forms a ground plane for the radiating elements. A drawback of this design is non-coincident phase centers of the vertical and horizontal elements. A second drawback of this design is caused by the ground plane which causes large reflections of incident energy and can be detrimental in some applications.

A second antenna design using notch antenna elements is shown in U.S. Pat. No. 4,978,965 to Mohuchy. The Mohuchy patent discloses a dual polarized radiating element composed of a notched radiator and a dipole radiator interlocked and orthogonal to each other. The described element has coincident phase centers and is backed by a structural absorber and solves the mechanical crossover problem with the feed network. A drawback of this design is that the two polarizations have different radiating elements with different performance qualities, which can be detrimental in certain applications.

There remains a need in the art for a dual-polarization radiator with orthogonal elements having coincident phase centers, wherein the orthogonal elements have about the same element pattern shape and performance characteristics, and wherein the radiators can be easily manufactured and assembled into a variety of phased array configurations.

SUMMARY OF THE INVENTION

An object of the present invention is to provide a dual-polarization radiator with orthogonal radiating elements which can be combined through an RF device with other similarly constructed radiators into a variety of phased array configurations compatible with at least one of wide bandwidth applications, wide scan-angle applications, microstrip circuitry, low cost batch fabrication, and coincident phase centers.

Specifically, an inventive dual-polarization radiator includes two dual planar notch radiating elements interlocked and orthogonal to each other. The radiating elements are preferably mounted on a ground plane covered by a structural absorber. Similarly constructed elements, when placed in an array, preferably have conductive "bridges" placed between them shorting the elements to each other thus eliminating spurious resonances and element pattern distortion at higher frequencies. By dual planar notch is meant two notch antennas on one board, preferably in equal phase and magnitude. The feed system preferably includes a microstrip power divider and tapered impedance transformer.

The notched radiating elements are preferably fabricated from a dielectric material carrier or substrate which has exterior metallized regions to provide the respective radiating configurations and an exterior excitation means for exciting the respective radiating elements with energy from an RF device or for receiving incident RF energy.

Some of the advantages of this inventive dual-polarization radiatior include ease in array assembly due to the microstrip nature of the radiating elements and coincident phase centers using similar radiating elements that provide similar impedance and pattern performance for each polarization. The radiator can also improve the low frequency performance of an antenna array.

BRIEF DESCRIPTION OF THE DRAWINGS

A complete understanding of the present invention may be gained by considering the following detailed description in conjunction with the accompanying drawings, in which.

DETAILED DESCRIPTION OF THE PREFERRED EMBODIMENTS

Figure 1:
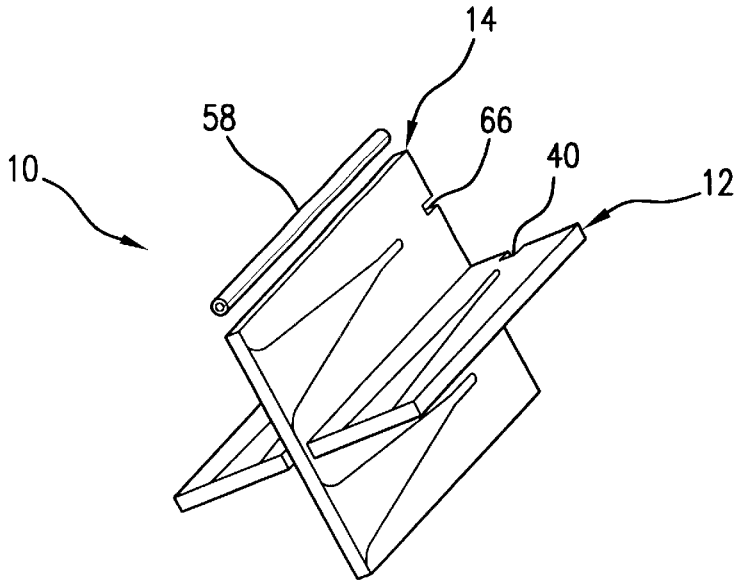
FIG. 1 is a perspective view showing a dual-polarized radiator with orthogonal dual notch radiating elements according to the present invention.

A dual-polarized radiator 10 for a broadband polarization-agile antenna array according to the present invention is shown in perspective in FIG. 1. The radiator 10 includes first and second dual notch radiating elements 12 and 14 arranged orthogonally relative to one another. Each dual notch radiating element is shown as a generally rectangular board fabricated from a planar substrate of a dielectric material having conductive metallized regions thereon defining two notch antennas.

Figure 2:
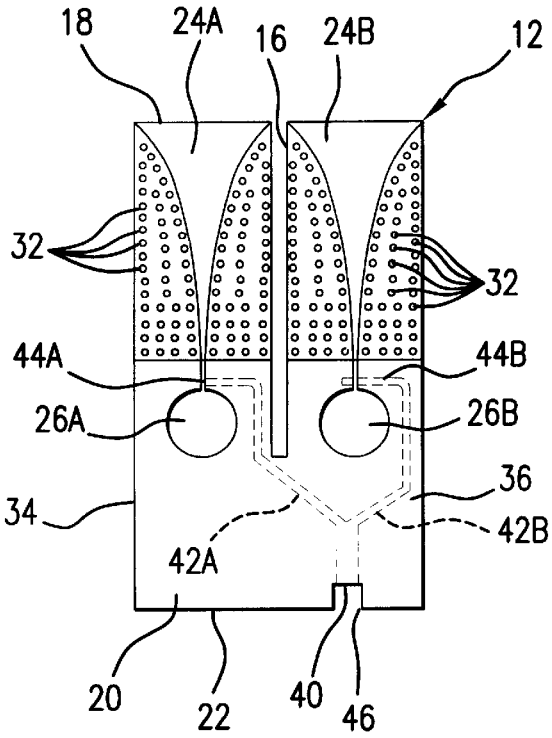
FIG. 2 is a plan view showing one side of a radiating element for use in fabricating a dual-polarized radiator according to the present invention.

FIG. 2 is a plan view showing one side of the first dual notch radiating element 12. A slot 16 extends rearwardly from a forward edge 18 of the element along a centerline thereof to receive the second dual notch radiating element as described in greater detail below. The metallized regions 20 on this side of the element extend across the width of the element from the forward edge 18 to a rear edge 22; however, a pair of notches 24A and 24B are formed in the metallized regions on opposite sides of the slot 16 to define a pair of notch antennas. Each notch extends from a circular tuning element 26A or 26B adjacent a terminal end of the slot 16 to the forward edge 18 of the element. The notches are shown having an exponentially tapered or flared profile but can be stepped or have any other configuration suitable to form a notch antenna.

Figure 3:
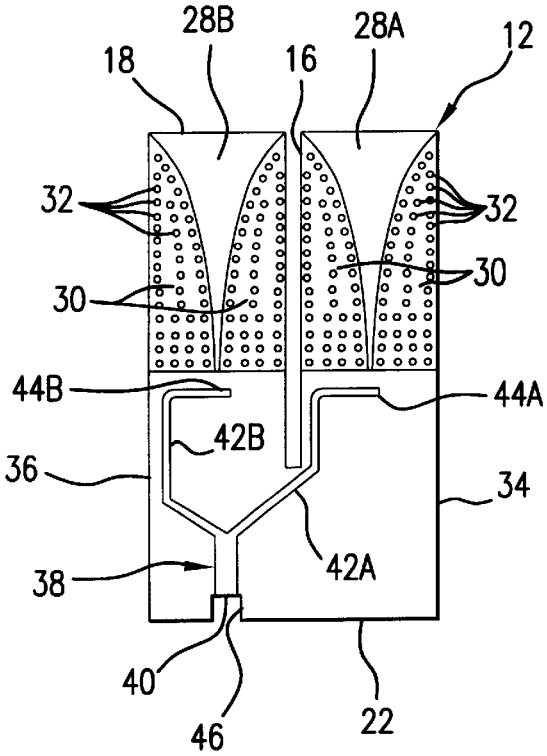
FIG. 3 is a plan view showing the other side of the radiating element shown in FIG. 2.

FIG. 3 is a plan view showing the other side of the first radiating element 12. As can be seen, a pair of notches 28A and 28B are formed by metallized regions 30 on opposite sides of the respective notches. These metallized regions are electrically connected to the metallized regions 20 on the other side of the element by a plurality of conductively plated vias or pins 32 extending through the substrate at spaced locations throughout the region between the notches 28A and 28B and lateral edges 34 and 36 of the element. In this manner, optimal ground plane continuity is achieved.

Referring still to FIG. 3, a conductive microstrip feed 38 extends forwardly along the surface of the substrate from a conductive input contact 40 at the rear edge 22 of the element 12 and bifurcates to form a pair of conductive arms 42A and 42B. The arms 42A and 42B extend forwardly and bend in the same direction to terminate at conductive vias or pins 44A and 44B that extend through the substrate to the metallized region on the opposite side of the element to feed both notches on the element. The arms 42A and 42B are configured such that the two notch antennas are in equal phase and magnitude. Preferably, the length and width of the arms are the same. The input contact 40 is shown disposed within a slot 46 in the rear edge 22 of the element 12, the slot being configured to receive a conductive mating pin on a mounting block or the like.

The second radiating element 14 is preferably identical to the first radiating element 12 but with a slot extending forwardly from a rear edge thereof to receive the first element. The first and second radiating elements 12 and 14 can be assembled together to form a dual-polarized radiator 10 by arranging the first and second elements orthogonal to one another with the slot in the forward edge of the first element aligned with the slot in the rear edge of the second element. The elements are then moved into one another until the first element 12 is received in the slot formed in the second element 14, and the second element is received in the slot formed in the first element, as shown in FIG. 1. The first and second elements 12 and 14 thus have coincident phase centers that provide similar impedance and pattern performance for each polarization.

The dual-notch elements offer mechanical and electrical advantages over a single notch element. Mechanically it permits the physical crossover of the excitation transmission lines at the electrical phase center of each orthogonally-disposed element. Electrically it provides two additional tuning parameters for broadbanding the input impedance, which directly affects the radiation efficiency. The added tuning parameters are the shunt impedance of the microstrip lines 42A and 42B and the longitudinal resonance characteristics of the dual-notch configuration.

Figure 4:
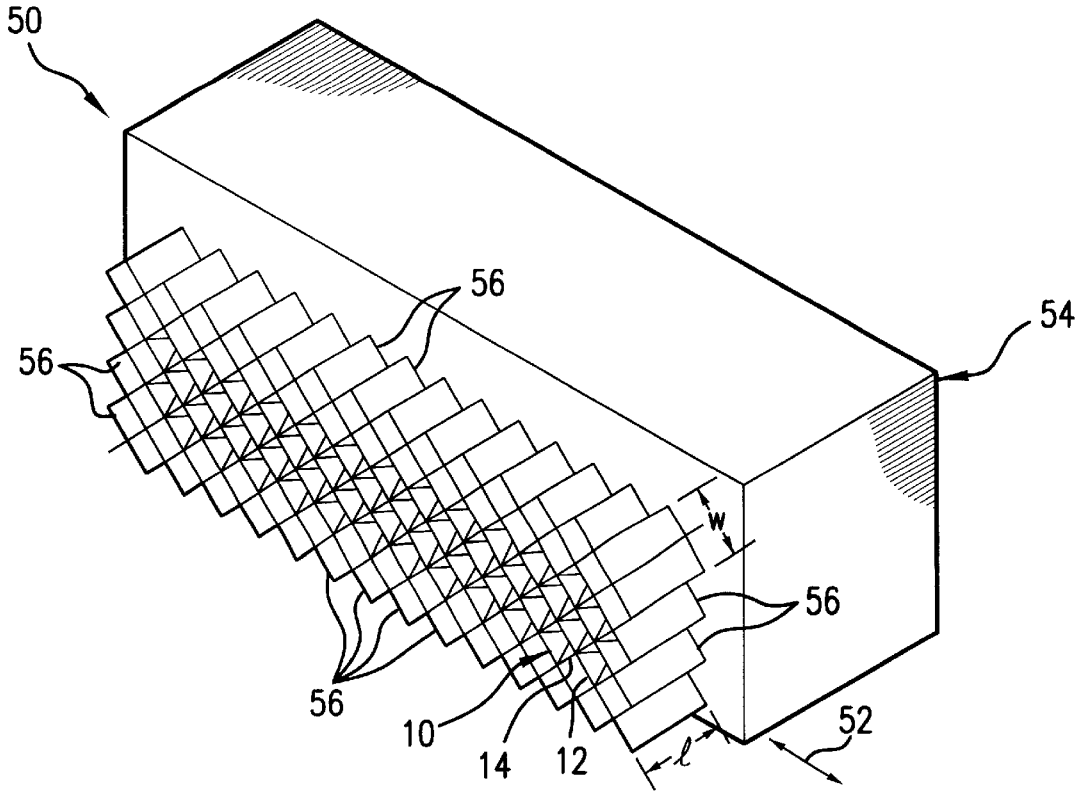
FIG. 4 is a perspective view showing a phased array antenna made up of dual-polarized radiators according to the present invention.

Dual-polarized radiators of the type described above can be assembled into a variety of phased array configurations. For example, FIG. 4 shows a perspective view of an embodiment of a phased array antenna 50 made up of dual-polarized radiators 10 according to the present invention. The illustrated antenna 50 includes two rows of dual-polarized radiators 10 arranged linearly along a first direction or axis 52 on a mounting structure or block 54, with first and second radiating elements 12 and 14 of each radiator being oriented at a non-zero angle relative to the first direction. Preferably, the radiating elements of each radiator are oriented diagonally at an angle of about 45 degrees relative to the first direction to reduce in half the effective spacing between elements in the first direction.

The illustrated antenna array 50 also includes a plurality of terminated or dummy edge elements 56 mounted on the block 54 about the periphery of the active elements 10 of the array. Each of the terminated edge elements 56 is preferably identical to the active radiators 10 described above but with features, such as a resistance terminating each notch, rendering it inactive. The identical structure preserves mutual coupling effects between the active and inactive elements so that the active elements on the periphery of the array suffer fewer edge effects.

The antenna array 50 preferably also includes a plurality of conducting pieces (see element 58 in FIG. 1) placed between adjacent radiators of the array to allow for the flow of current between the radiating elements to eliminate spurious resonances and element pattern distortion at higher frequencies. The conducting pieces can have any configuration to fit between adjacent radiators but are preferably formed of tubular elements made of a crushable conducting material such as metex. The tubular elements are crushed between abutting lateral edges of the radiators and can thus be held in place without solder or other attachments. Similar conducting pieces are preferably placed between the first and second radiating elements of each radiator within the slots (e.g., element 16 in FIGS. 2 and 3) formed therein to establish ground plane continuity.

The mounting block 54 can be formed of any material offering sufficient RF shielding to isolate the elements from one another and providing adequate thermal dissipation. The mounting block preferably includes an absorbing material placed over the ground plane and between the elements to reduce reflections from the ground plane and spurious radiation from the microstrip feed.

To preclude the formation of secondary radiating lobes that can adversely affect the net radiated gain of the array, the array should be designed such that:

$$\lambda/s \leq 1+\sin\theta$$

wherein $\lambda$ is the free-space wavelength at the highest operating frequency of the antenna, s is the radiator spacing, and $\theta$ is the maximum scan angle of the phased array. In an exemplary embodiment, suitable over a bandwidth of about 4–20 GHz, the radiating elements each have a length 1 of about 1.500 inches, a width w of about 0.587 inch, and a thickness of about 0.020 inch. These dimensions meet the above condition for the specified bandwidth when the radiating elements are arranged diagonally as described above. The number of radiators shown in the illustrated array 50 is arbitrary. It will be appreciated that the actual number of elements is determined by system gain requirements as calculated using known physical relationships.

Figure 5:
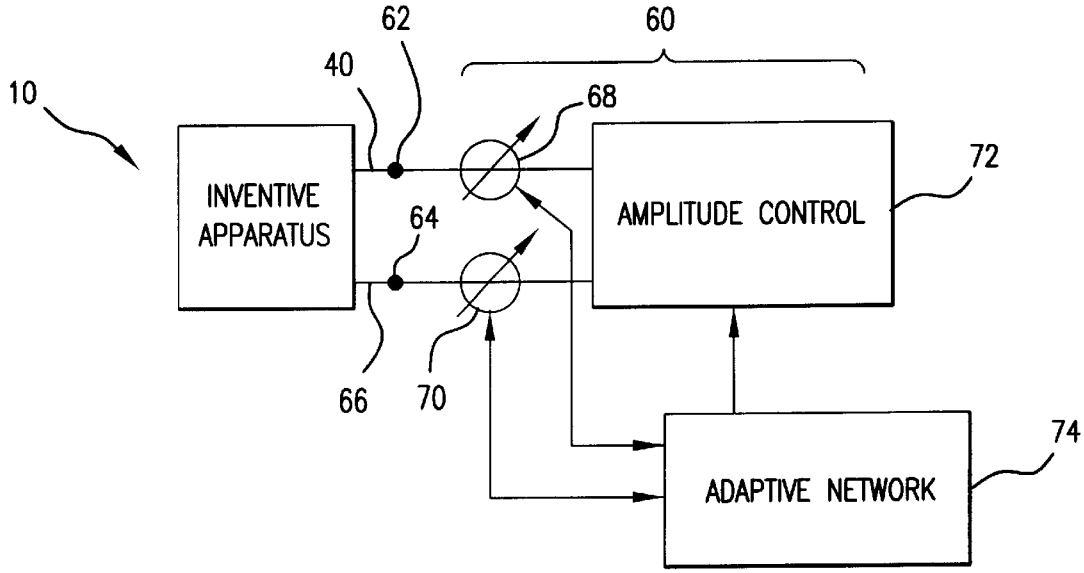
FIG. 5 is a block diagram showing a polarization control network for use with dual-polarized radiators according to the present invention.

An array utilizing dual-polarized radiators of the type described above can be coupled with any type of known excitation means for exciting the respective radiating elements with energy from an RF device or for receiving incident RF energy. FIG. 5 shows a block diagram of an embodiment of a polarization control network 60 for a dual-polarized radiator 10 according to the present invention. The network 60 includes a pair of ports 62 and 64 that are connected to respective RF input ports 40 and 66 of the dual-polarized radiator 10. In the receive function, incoming signals which are received by the inventive radiator are coupled through the ports 62 and 64 to a pair of adjustable phase shifters 68 and 70. The outputs from the adjustable phase shifters 68 and 70 are applied as inputs to an amplitude control unit 72 and an adaptive network 74, respectively, to provide a total analysis of the polarization state of the input RF field. Any conventional amplitude control unit and adaptive network can be used in the polarization control network 60.

Similarly, on transmit, an input to the amplitude control unit 72 via the ports 62 and 64 may be adjusted to produce any desired polarization of the field radiated from the radiator 10. Further, in this configuration, any suitable adaptive network 74 can be used to perform the phase and amplitude adjustments automatically as an electronic servo loop to bring the input/output wavefronts in the dual-polarized radiator to a desired state.

Figure 6:
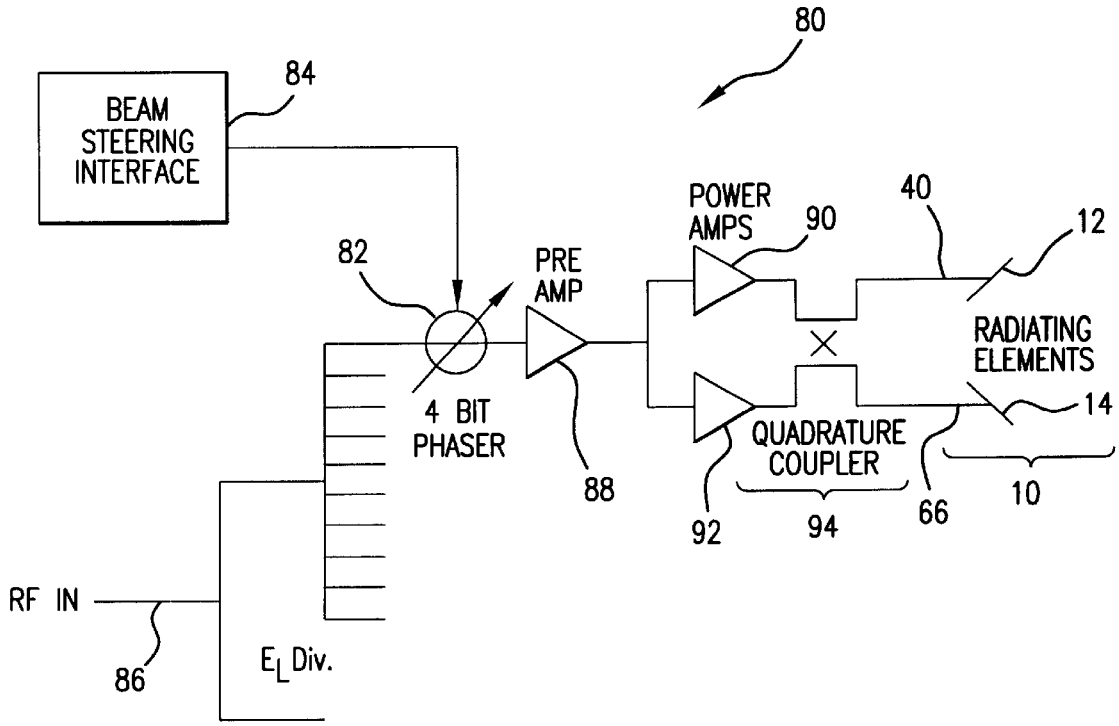
FIG. 6 is a block diagram showing a dual-circular radiator device using dual-polarized radiators according to the present invention.

FIG. 6 shows a block diagram of an embodiment of a dual-circular RF radiator device 80 using a dual-polarized radiator 10 according to the present invention. The dual-circular radiator device 80 includes a phase shifter 82 connected to a beam steering interface 84. The phase shifter 82 receives an RF input 86 and provides a phase-shifted output to a pre-amplifier 88. The pre-amplifier 88 provides a pre-amplified output that is applied to a pair of power amplifiers 90 and 92 in parallel. Outputs from the power amplifiers 90 and 92 are fed to respective radiating elements 12 and 14 of a dual-polarized radiator via a quadrature coupler 94.

In accordance with well known properties of a quadrature coupler, if RF energy is applied to a first input terminal of the coupler and the output therefrom is applied, in turn, to the input ports of the radiator, then the radiator will radiate a right-hand circularly polarized field. If, on the other hand, RF energy is applied to the other input terminal, then the radiator will radiate a left-hand circularly polarized field. Further, in accordance with with the well known principle of reciprocal operation, if radiation is received by the radiator the outputs at the terminals of the quadrature coupler will be right-handed and left-handed circularly polarized components thereof, respectively.

While the invention has been described in detail above, the invention is not intended to be limited to the specific embodiments as described. It is evident that those skilled in the art may now make numerous uses and modifications of and departures from the specific embodiments described herein without departing from the inventive concepts. For example, the radiating elements can be formed with any type of notch including, but not limited to, the exponentially tapered or flared configuration shown or conventional stepped configurations. While the notches are shown extending from circular tuning elements, it will be appreciated that tuning elements of different configuration can be used such as, for example, slots and stubs. The radiating elements can be formed by etching metal clad dielectric substrates, by depositing metal on a bare dielectric substrate, or in any other conventional manner. The substrate can be fabricated from any dielectric material known to those of ordinary skill in the art including, but not limited to, Teflon fiber glass or Duroid. The metallized regions can be formed of any conductive metal but are preferably formed of copper or, more preferably, gold-flashed copper.

Figure 7:
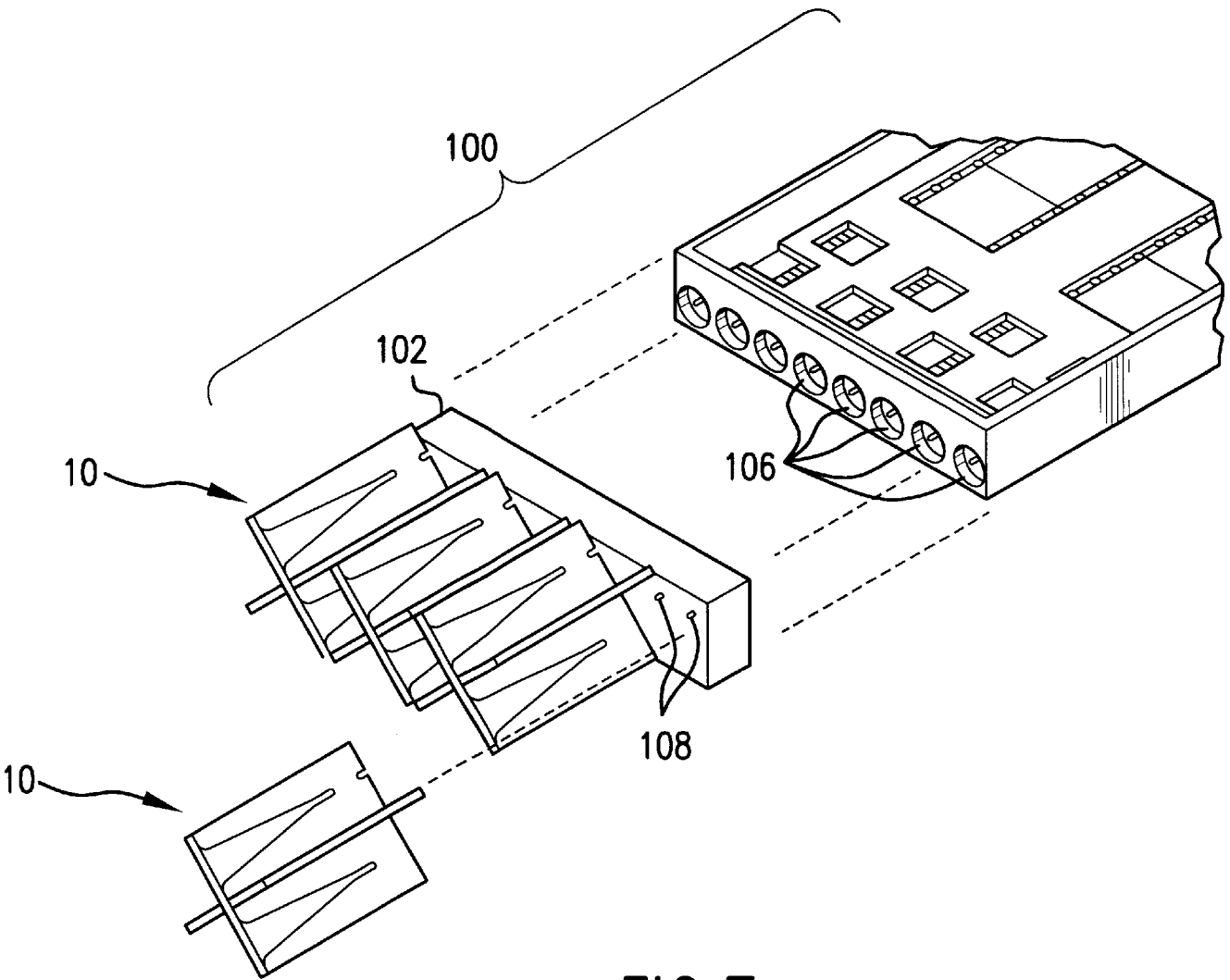
FIG. 7 is a fragmentary perspective view of an antenna module using dual-polarized radiators according to the present invention.

It will be appreciated that any number of dual-polarized radiators can be arranged in an array to form a polarization-agile broadband antenna. The radiators can be mounted on a common mounting block to form an array as shown in FIG. 4 or the array can be formed of a plurality of individual modules 100, each of which is made up of a plurality of dual-polarized radiators 10 arranged in a linear array on a mounting block 102, for example as shown in FIG. 7. The dual-polarized radiators of the present invention can be coupled with RF circuitry using any suitable connectors but are preferably mounted on a mounting block having coaxial connectors arranged on a back side of the block to couple with mating coaxial connectors extending from the RF circuitry such as the conventional GPO connectors 106 shown in FIG. 7, and microstrip connectors, such as the pins 108 in FIG. 7, arranged on the front side of the block to couple with the radiators 10. Other suitable coaxial connectors include, but are not limited to, conventional SMA or TNC connectors.

What is claimed is:

1. A dual polarized radiator for a phased array antenna, said radiator comprising a first planar radiating element defining a first pair of notch antennas in a first plane and a second planar radiating element defining a second pair of notch antennas in a second plane oriented perpendicular to said first plane, said first and second radiating elements intersecting one another such that a phase center of said first radiating element coincides with a phase center of said second radiating element.

2. The dual polarized radiator of claim 1, wherein each radiating element includes a dielectric substrate with metallized regions on both sides of said substrate, wherein a pair of notches are formed in said metallized regions on both sides of said substrate to define said notch antennas.

3. The dual polarized radiator of claim 2, wherein metallized regions on both sides of said substrate are connected by a plurality of conductive vias formed through said substrate on opposite sides of said notches.

4. The dual polarized radiator of claim 2, wherein a first slot extends rearwardly from a forward edge of said first radiating element and a second slot extends forwardly from a rear edge of said second radiating element, said first radiating element being received in said second slot and said second radiating element being received in said first slot.

5. The dual polarized radiator of claim 4, wherein said slots extend along respective centerlines of said first and second radiating elements between said notch antennas.

6. The dual polarized radiator of claim 1, further comprising a microstrip on each element extending along said respective substrates to said metallized regions defining said radiating notch antennas.

7. The dual polarized radiator of claim 6, wherein each microstrip is bifurcated to equally divide energy applied to and extracted from the radiating notch antennas and apply the energy at the same phase to the radiating antennas.

8. The dual polarized radiator of claim 7, wherein each microstrip extends from a conductive contact disposed in a slot formed in a rear edge of a respective radiating element.

9. A phased array antenna comprising a plurality of dual-polarized radiators as set forth in claim 1, wherein said dual-polarized radiators are arranged in an array.

10. The phased array antenna of claim 9, wherein said array includes a plurality of radiators arranged linearly in a first direction and said first and second radiating elements of each radiator are oriented at a non-zero angle relative to said first direction.

11. The phased array antenna of claim 10, wherein said radiating elements of each radiator are oriented at an angle of about 45 degrees relative to said first direction.

12. The phased array antenna of claim 9, further comprising terminated edge elements disposed about at least a portion of a periphery of said array of radiators.

13. The phased array antenna of claim 9, further comprising a ground plane mounting said radiators and an RF absorbing material placed between said ground plane and said radiators to reduce reflections from the ground plane and spurious radiation from feed lines.

14. The phased array antenna of claim 9, further comprising a plurality of conducting pieces attached between adjacent radiating elements of the array to allow for the flow of current between said radiating elements.

15. The phased array antenna of claim 9, further comprising a mounting block having a plurality of coaxial connectors on a first side electrically connected to a plurality of stripline connectors on a second side, wherein said plurality of coaxial connectors are adapted to mate with coaxial connectors extending from an RF excitation network and said plurality of stripline connectors are adapted to receive said radiators.

16. The phased array antenna of claim 15, wherein said mounting block is formed of a radio frequency-absorbing material with high thermal conductivity.

17. The phased array antenna of claim 9, further comprising a plurality of antenna modules, wherein each of said antenna modules includes at least one of said dual-polarized radiators mounted on a mounting block.

18. The phased array antenna of claim 9, wherein said radiating elements are configured such that:

$$\lambda/s \leqq 1+\sin\theta$$

wherein $\lambda$ is the free-space wavelength at the highest operating frequency of the antenna, s is the radiator spacing, and $\theta$ is the maximum scan angle of the phased array.

* * * * *